US010353340B2

(12) United States Patent
Kuroiwa et al.

(10) Patent No.: US 10,353,340 B2
(45) Date of Patent: Jul. 16, 2019

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Ikuyo Kuroiwa, Tokyo (JP); Kumiko Takizawa, Saitama (JP); Tsuyoshi Shimada, Toride (JP); Eileen Takeuchi, Toride (JP); Wataru Kitamura, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/946,208

(22) Filed: Apr. 5, 2018

(65) Prior Publication Data

US 2018/0299822 A1 Oct. 18, 2018

(30) Foreign Application Priority Data

Apr. 18, 2017 (JP) ..... 2017-082171

(51) Int. Cl.
*G03G 21/18* (2006.01)
*G03G 5/14* (2006.01)

(52) U.S. Cl.
CPC ..... *G03G 21/1814* (2013.01); *G03G 5/142* (2013.01); *G03G 5/144* (2013.01); *G03G 2215/00957* (2013.01)

(58) Field of Classification Search
CPC ..... G03G 5/04; G03G 5/0612; G03G 5/0609; G03G 5/0662; G03G 21/1814; G03G 5/144; G03G 2215/00957
See application file for complete search history.

(56) References Cited

U.S. PATENT DOCUMENTS

| | | | |
|---|---|---|---|
| 5,198,685 | A | 3/1993 | Kitana et al. |
| 5,876,890 | A | 3/1999 | Kitamura et al. |
| 5,912,098 | A | 6/1999 | Tanaka et al. |
| 6,405,005 | B1 | 6/2002 | Kitamura et al. |
| 7,645,547 | B2 | 1/2010 | Okuda et al. |
| 7,655,370 | B2 | 2/2010 | Kitamura et al. |
| 7,813,675 | B2 | 10/2010 | Tanabe et al. |
| 9,568,846 | B2 | 2/2017 | Kawaguchi et al. |
| 9,766,561 | B2 | 9/2017 | Takahashi et al. |

(Continued)

FOREIGN PATENT DOCUMENTS

| | | |
|---|---|---|
| JP | 2011-107615 A | 6/2011 |
| JP | 2016-110127 A | 6/2016 |

OTHER PUBLICATIONS

U.S. Appl. No. 15/958,464, Eileen Takeuchi, filed Apr. 20, 2018.
U.S. Appl. No. 15/960,916, Tsuyoshi Shimada, filed Apr. 28, 2018.

*Primary Examiner* — Thorl Chea
(74) *Attorney, Agent, or Firm* — Venable LLP

(57) ABSTRACT

There is provided an electrophotographic photosensitive member in which the variation in potential during repeated use is reduced. The electrophotographic photosensitive member is the electrophotographic photosensitive member of which an undercoat layer comprises a urethane resin and titanium oxide particles whose primary particle and secondary particle diameters are defined.

13 Claims, 5 Drawing Sheets

(56) References Cited

U.S. PATENT DOCUMENTS

| | | | | |
|---|---|---|---|---|
| 9,791,792 | B2 | 10/2017 | Miyauchi et al. | |
| 9,811,012 | B2 | 11/2017 | Murakami et al. | |
| 9,817,324 | B2 | 11/2017 | Kitamura et al. | |
| 9,971,258 | B2 | 5/2018 | Kitamura et al. | |
| 9,983,490 | B2 | 5/2018 | Shimada et al. | |
| 2006/0014090 | A1* | 1/2006 | Shiino | G03G 5/0605 430/59.1 |
| 2009/0208250 | A1* | 8/2009 | Mitsumori | G03G 5/056 399/159 |
| 2014/0004450 | A1 | 1/2014 | Tokimitsu et al. | |
| 2017/0108790 | A1 | 4/2017 | Takahashi et al. | |

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a method of producing an electrophotographic photosensitive member, a process cartridge, and an electrophotographic apparatus.

Description of the Related Art

Recently, there has been used an electrophotographic photosensitive member (an organic electrophotographic photosensitive member) including an undercoat layer containing metal oxide particles and an organic compound which is formed on a support; and a photosensitive layer having a charge generation material formed on the undercoat layer and a charge transport material as an electrophotographic apparatus.

The potential characteristics (charging ability and sensitivity) of the electrophotographic photosensitive member is dependent on the kind of materials used for the undercoat and photosensitive layers. Particularly, the metal oxide particles and organic compound used for the undercoat layer are materials which substantially influence the potential characteristics of the electrophotographic photosensitive member. Therefore, it is found that the potential characteristics of the electrophotographic photosensitive member can be improved according to the structure and combination of the materials.

It goes without saying that, with the improvement in speed (improvement in process speed) of the electrophotographic apparatus, there is a need for improvements in charging ability and potential characteristics (such as an increase in sensitivity). There is also an object to reduce variation in potential (variation in charging ability, variation in sensitivity) during repeated use.

In order to suppress the above-described defects, there has been proposed a method of allowing the undercoat layer to contain a metal oxide such as titanium oxide. Japanese Patent Application Laid-Open No. 2011-107615 proposes an electrophotographic photosensitive member in which the electrical conductivity of a preparation solution for an undercoat layer containing titanium oxide particles is adjusted by subjecting titanium oxide particles treated with inorganic silica to ultrasonic treatment, thereby reducing variation in potential.

Further, Japanese Patent Application Laid-Open No. 2016-110127 proposes an electrophotographic photosensitive member including an undercoat layer containing titanium oxide particles surface-treated with aminosilane. In this patent literature, titanium oxide particles having an average primary particle diameter of 100 nm or more to 600 nm or less and zinc oxide particles are contained. Further, the characteristics of the undercoat layer are changed by adjusting the volume ratio of the titanium oxide particle to the zinc oxide particles in an undercoat layer.

An object of each of the techniques in related art is to provide an electrophotographic photosensitive member in which image defects such as black spots are reduced while reducing the variation in potential (variation in charging ability and variation in sensitivity) during repeated use.

The present inventors have examined, and as a result, they have found that there is a room for improvement in the reduction of the variation in potential during repeated use, depending on the kind of metal oxide contained in the undercoat layer, the number average particle diameter of metal oxide primary particles, the number average particle diameter of the secondary particles in the undercoat layer, and a combination of a metal oxide and a binder resin.

SUMMARY OF THE INVENTION

An object of the present invention is to provide an electrophotographic photosensitive member in which the potential change during repeated use is reduced.

Another object of the present invention is to provide a process cartridge having the above electrophotographic photosensitive member and an electrophotographic apparatus.

The present invention is an electrophotographic photosensitive member including a support, an undercoat layer on the support, and a photosensitive layer on the undercoat layer, wherein the undercoat layer contains a urethane resin as a binder resin and titanium oxide secondary particles (i.e., aggregated titanium oxide primary particles), the number average particle diameter of the titanium oxide primary particles is 1 nm or more to 10 nm or less, and the number average particle diameter of the titanium oxide secondary particles is 200 nm or more to 500 nm or less.

Further features of the present invention will become apparent from the following description of exemplary embodiments with reference to the attached drawings.

DESCRIPTION OF THE EMBODIMENTS

Figure 1:
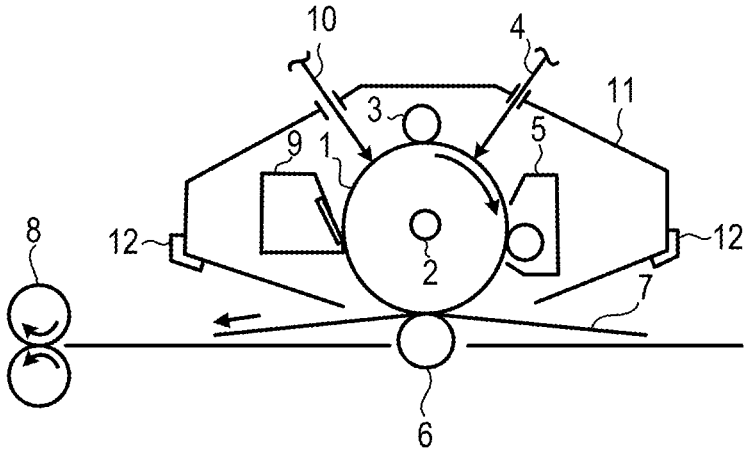
FIG. 1 is a view illustrating an example of a schematic structure of an electrophotographic apparatus including a process cartridge having an electrophotographic photosensitive member.

Preferred embodiments of the present invention will now be described in detail in accordance with the accompanying drawings.

In one embodiment of the present invention, an undercoat layer of an electrophotographic photosensitive member contains a urethane resin as a binder resin and titanium oxide primary particles having a number average particle diameter of 1 nm or more to 10 nm or less as metal oxide particles. The electrophotographic photosensitive member includes secondary particles (i.e., aggregated primary particles) having a number average particle diameter of 200 nm or more to 500 nm or less and being dispersed in the binder resin.

Further, a process cartridge integrally supports the electrophotographic photosensitive member and at least one unit selected from the group consisting of a charging unit, a developing unit, a transferring unit, and a cleaning unit, and is detachably attachable from the main body of the electrophotographic apparatus.

Further, an electrophotographic apparatus includes the electrophotographic photosensitive member, a charging unit, an exposing unit, a developing unit, and a transferring unit.

The electrophotographic apparatus may be characterized in that the charging unit is a charging unit which charges the electrophotographic photosensitive member by applying only a direct current voltage to a charging roller disposed so as to abut on the electrophotographic photosensitive member.

Regarding the reason why metal oxide particles, particularly secondary particles (i.e., aggregated titanium oxide primary particles having a small number average particle diameter) and a urethane resin are contained in the undercoat layer, thereby reducing variation in potential during repeated use, the present inventors assume as follows.

The titanium oxide particles contained in the undercoat layer play a role in conductivity of the undercoat layer. However, the giving and receiving of charges between the titanium oxide particles in the undercoat layer are easily disrupted. In the present invention, it has been examined that an aggregate obtained by decreasing the number average particle diameter (hereinafter, also referred to as "primary particle diameter") of titanium oxide primary particles to be dispersed in the undercoat layer, and aggregating the resultant product is contained in the undercoat layer. As a result, it has been found that variation in potential, particularly, variation in sensitivity (variation Vl) can be reduced. This is considered to be due to the fact that, when aggregated conventional titanium oxide particles having a particle diameter of larger than 10 nm are compared to aggregated titanium oxide particles having a particle diameter smaller than that, the giving and receiving of charges between primary particles are smoothly performed in the case of the latter aggregated titanium oxide particles. Accordingly, it is entirely assumed that the giving and receiving of charges in the undercoat layer are smoothly performed, whereby it is possible to reduce the residual charges in the undercoat layer and suppress an influence on the variation Vl during repetitive image formation. Although the variation Vl can be suppressed by the above method, variation in charging ability may not be suppressed depending on the combination of the binder resin. After repeated use of an undercoat layer configured to include a nylon resin containing titanium oxide particles having a small particle diameter, the charging ability has been decreased. This is assumed to be due to the fact that the giving and receiving of charges between titanium oxide particles are improved since the resistance of the binder resin is low, and further the resistance of the whole undercoat layer is so far reduced, thereby causing a decrease in charging ability. In the case of combining with a binder resin having low resistance, image defects such as black spots have been observed.

Then, in the present invention, a high-resistant urethane resin has been used as the binder resin when using the titanium oxide particles having a small particle diameter. The used urethane resin is a urethane resin whose resistance is 1-digit higher than that of the nylon resin which has caused variation in potential. The high-resistant urethane resin is combined with the titanium oxide particles having a small particle diameter, whereby it is possible to maintain a conductive path for giving and receiving charges in the undercoat layer from aggregated titanium oxide particles dispersed in the undercoat layer, in a state of keeping the resistance of the whole undercoat layer in an appropriate range. Thus, a balance between a decrease in charging ability (variation Vd) and a decrease in sensitivity (variation Vl) is maintained so that it is possible to reduce image defects due to partial leakage from the undercoat layer, such as black spots.

<Electrophotographic Photosensitive Member>

The electrophotographic photosensitive member according to one embodiment of the present invention is an electrophotographic photosensitive member having a support, an undercoat layer formed on the support, and a photosensitive layer on the undercoat layer. A conductive layer may be formed between the support and the undercoat layer. The photosensitive layer is preferably a layered photosensitive layer having a charge generation layer containing charge generation material and a charge transport layer containing a charge transport material.

Figure 2:
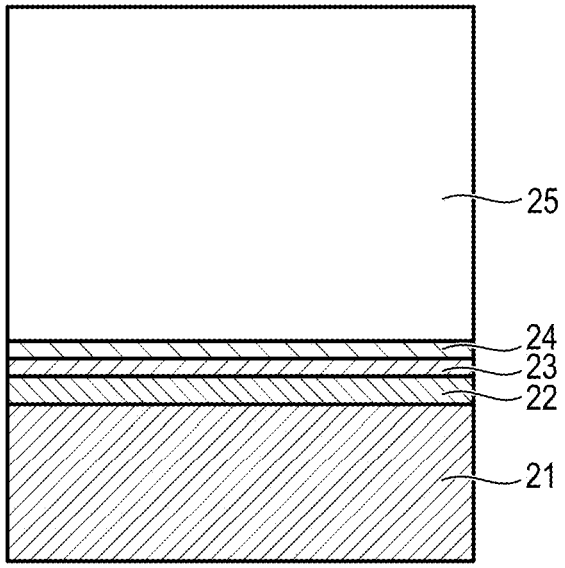
FIG. 2 is a view for explaining a layer structure of the electrophotographic photosensitive member.

FIG. 2 is a view illustrating an example of a layer structure of the electrophotographic photosensitive member.

In FIG. 2, the electrophotographic photosensitive member has a support 21, an undercoat layer 22, a charge generation layer 23, a charge transport layer 24, and a protective layer 25. In this case, the charge generation layer 23 and the charge transport layer 24 configure a photosensitive layer, and the protective layer 25 is a surface layer. When the protective layer is not formed, the charge transport layer 24 is the surface layer. In the present invention, it is preferable that the protective layer on the charge transport layer is the surface layer.

Hereinafter, the support and each of the layers will be described.

<Support>

In the present invention, the electrophotographic photosensitive member has a support. In the present invention, the support is preferably a conductive support having conductivity. Examples of the shape of the support include a cylindrical shape, a belt shape, and a sheet shape. Among them, the cylindrical shape is preferred for the support. Further, in order to reduce interference fringes caused by scattering of laser light, the surface of the support may be subjected to electrochemical treatment such as anodic oxidation, a grinding treatment, or a honing treatment. Among them, the grinding and honing treatments are preferred.

The material of the support is preferably a metal, a resin, glass, or the like.

Examples of the metal include aluminum, iron, nickel, copper, gold, stainless steel, and alloys thereof. Among, an aluminum support obtained by using aluminum is preferred.

Further, the resin or glass may be mixed or coated with a conductive material so as to impart conductivity.

<Conductive Layer>

In the present invention, a conductive layer may be formed on the support. The conductive layer is formed so that it is possible to cover scratches and concave/convex portions and control the reflection of light on the surface of the support.

It is preferred that the conductive layer contains conductive particles and a resin.

Examples of the material of the conductive particles include metal oxides, metals, and carbon black.

Examples of the metal oxides include zinc oxide, aluminum oxide, indium oxide, silicon oxide, zirconium oxide, tin oxide, titanium oxide, magnesium oxide, antimony oxide, and bismuth oxide. Examples of the metals include aluminum, nickel, iron, nichrome, copper, zinc, and silver.

Among them, it is preferable to use metal oxide as conductive particles. Particularly, it is more preferable to use titanium oxide, tin oxide, and zinc oxide.

When the metal oxide is used as the conductive particles, the surface of the metal oxide may be treated with a silane coupling agent or the like, or the metal oxide may be doped with an element such as phosphorus or aluminum or the oxide thereof.

Further, the conductive particles may have a layered structure which include core material particles and a covering layer for covering the particles. Examples of the core material particles include titanium oxide, barium sulfate, and zinc oxide. Examples of the covering layer include metal oxides such as tin oxide.

Further, when particles of metal oxide are used as conductive particles, the volume average particle diameter is preferably 1 nm or more to 500 nm or less and more preferably 3 nm or more to 400 nm or less.

Examples of the resin include a polyester resin, a polycarbonate resin, a polyvinyl acetal resin, an acrylic resin, silicone resin, an epoxy resin, a melamine resin, a polyurethane resin, a phenol resin, and an alkyd resin.

Further, the conductive layer may further contain a masking agent such as silicone oil, resin particles, or titanium oxide.

The average thickness of the conductive layer is preferably 1 μm or more to 50 μm or less and particularly preferably 3 μm or more to 40 μm or less.

The conductive layer can be formed by preparing a conductive layer coating liquid containing the above materials and a solvent, forming a film of the coating liquid, and drying it. Examples of the solvent used for the coating liquid include an alcohol solvent, a sulfoxide solvent, a ketone solvent, an ether solvent, an ester solvent, and an aromatic hydrocarbon solvent. The conductive particles are dispersed in the conductive layer coating liquid by a method using, for example, a paint shaker, a sand mill, a ball mill, or a liquid collision type high-speed disperser.

<Undercoat Layer>

An undercoat layer is formed between the support or the conductive layer and the photosensitive layer (charge generation and charge transport layers).

In the present invention, the metal oxide particles contained in the undercoat layer are titanium oxide particles.

The titanium oxide particles in the present invention have preferably a primary particle diameter of 1 nm or more to 10 nm or less and particularly preferably of 3 nm or more to 6 nm or less. Particles having a primary particle diameter of less than 1 nm are used, whereby it becomes difficult to control dispersion state. Preferably, aggregated titanium oxide particles (secondary particles) formed in the formed undercoat layer have a number average particle diameter (hereinafter, also referred to as "secondary particle diameter") of 200 nm or more to 500 nm or less. When the diameter is less than 200 nm, it is difficult to control the dispersion state, and there is a concern over a decrease in the effects of reducing interference fringes. When the diameter is larger than 500 nm, the conductivity in the undercoat layer becomes unstable and there are concerns over deterioration of the variation in potential and black spots.

Regarding the content of the titanium oxide particles in the undercoat layer, a mass ratio (P/B) between a mass (P) of the titanium oxide primary particles and a mass (B) of the urethane resin as the binder resin is preferably in a range of 0.5/1.0 to 4.0/1.0. The mass ratio is more preferably in a range of 0.5/1.0 to 3.0/1.0. The mass ratio is still more preferably in a range of 1.0/1.0 to 3.0/1.0. This range is derived from the viewpoints of the dispersibility, the limitation of a favorable coating film, and the adhesion to the cylinder.

Further, the metal oxide particles treated with a surface treatment agent are used, whereby the variation in potential after repeated use is further reduced. Particularly, the metal oxide particles are preferably particles whose surface is treated with a surface treatment agent such as a silane coupling agent.

Specific examples of the silane coupling agent include N-2-(aminoethyl)-3-aminopropylmethyldimethoxysilane, 3-aminopropylmethyldiethoxysilane, (phenylaminomethyl) methyldimethoxysilane, N-2-(aminoethyl)-3-aminoisobutylmethyldimethoxysilane, N-ethylaminoisobutylmethyldiethoxysilane, N-methylaminopropylmethyldimethoxysilane, N-2-(aminoethyl)-3-aminopropyltrimethoxysilane, 3-aminopropylmethyldiethoxysilane, (phenylaminomethyl)trimethoxysilane, N-2-(aminoethyl)-3-aminoisobutyltrimethoxysilane, N-ethylaminoisobutyltriethoxysilane, N-methylaminopropyltrimethoxysilane, and vinylsilane. However, the present invention is not limited to these examples. Further, the above silane coupling agents may be used in mixture of two or more kinds thereof.

Further, at least one compound selected from the group consisting of a compound represented by Formula (1) below and a compound represented by Formula (2) below as an additive may be mixed with the metal oxide particles and the binder resin. In Formula (1), $R^{a1}$ to $R^{a8}$ are each a compound independently representing a hydrogen atom, a hydroxy group, a halogen atom, an alkyl group, an alkoxy group, a phenyl group, or an amino group. In Formula (2), $R^{b1}$ to $Rb^{10}$ are each a compound independently representing a hydrogen atom, a hydroxy group, a halogen atom, an alkyl group, an alkoxy group, a phenyl group, or an amino group.

[Formulae (1) and (2)]

(1)

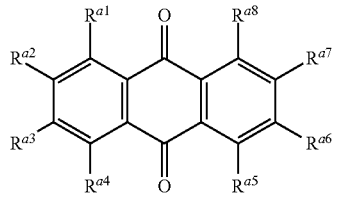

(2)

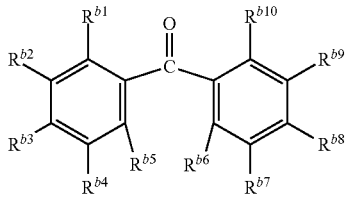

Examples of the compound represented by Formula (1) or (2) include a quinone compound, a fluorenone compound, an oxadiazole compound, a diphenoquinone compound, an alizarin compound, and a benzophenone compound. Particularly, the compound represented by Formula (1) or (2) is preferably either an anthraquinone compound having two or more hydroxy groups, or a benzophenone compound having three or more hydroxy groups.

Further, in the present invention, an organic resin contained in the undercoat layer is polyurethane.

In the present invention, the undercoat layer coating liquid for forming the undercoat layer may be an undercoat layer coating liquid obtained by subjecting metal oxide particles, an organic resin, or the raw material thereof, and a solvent to dispersion treatment. Alternatively, it may be an undercoat layer coating liquid obtained by adding a liquid obtained by dissolving an organic resin or the raw material thereof in a dispersion solution obtained by subjecting metal oxide particles to dispersion treatment and subjecting the resultant mixture to dispersion treatment.

The undercoat layer of the electrophotographic photosensitive member can be formed by applying a coating liquid obtained by these methods to form a film of the coating liquid and drying the resultant coating film by heating. Examples of the dispersion method include methods using a paint shaker, a sand mill, a ball mill, and a liquid collision type high-speed disperser.

Examples of the solvent to be used for the coating liquid of the undercoat layer include alcohol, sulfoxide, ketone, ether, ester, a halogenated aliphatic hydrocarbon, and an aromatic compound.

The undercoat layer of the electrophotographic photosensitive member may contain inorganic fine particles, organic resin fine particles, and a leveling agent in order to reduce interference fringes or improve the film formability. The leveling agent is used to reduce a defect phenomenon occurring in a step of drying the coating film and may be used to control the generation of Benard cells caused by the convection of the coating liquid around the metal particles. As the leveling agent, a siloxane compound or the like is generally used, and it is preferable to use a silicone oil as the leveling agent.

The thickness of the undercoat layer is preferably from 0.5 μm or more to 30 μm or less. The thickness is more preferably from 2 μm or more to 30 μm or less. The thickness is still more preferably from 2 μm or more to 10 μm or less. This is a range in which a favorable coating film can be formed, and the variation in potential can be reduced.

<Photosensitive Layer>

The photosensitive layer of the electrophotographic photosensitive member is mainly classified into a layered photosensitive layer (1) and a monolayer photosensitive layer (2). The layered photosensitive layer (1) has a charge generation layer containing a charge generation material and a charge transport layer containing a charge transport material. The monolayer photosensitive layer (2) has a photosensitive layer containing both the charge generation material and the charge transport material.

(1) Layered Photosensitive Layer

The layered photosensitive layer has a charge generation layer and a charge transport layer.

(1-1) Charge Generation Layer

The charge generation layer preferably contains a charge generation material and a resin.

Examples of the charge generation material include an azo pigment, a perylene pigment, a polycyclic quinone pigment, an indigo pigment, and a phthalocyanine pigment. Among them, the azo pigment and the phthalocyanine pigment are preferred. Among phthalocyanine pigments, an oxytitanium phthalocyanine pigment, a chloro gallium phthalocyanine pigment, and a hydroxy gallium phthalocyanine pigment are preferred.

The content of the charge generation material in the charge generation layer is preferably 40% by mass or more to 85% by mass or less and more preferably 60% by mass or more to 80% by mass or less relative to the total mass of the charge generation layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulosic resin, a polystyrene resin, a polyvinyl acetate resin, and a polyvinyl chloride resin. Among them, the polyvinyl butyral resin is more preferred.

Further, the charge generation layer may further contain an additive such as an antioxidant or an ultraviolet absorber. Specific examples thereof include a hindered phenol compound, a hindered amine compound, a sulfur compound, a phosphorus compound, and a benzophenone compound.

The average thickness of the charge generation layer is preferably from 0.1 μm or more to 1 μm or less and more preferably from 0.15 μm or more to 0.4 μm or less.

The charge generation layer can be formed by preparing a charge generation layer coating liquid containing the above materials and a solvent, forming a film of the coating liquid, and drying it. Examples of the solvent used for the coating liquid include an alcohol solvent, a sulfoxide solvent, a ketone solvent, an ether solvent, an ester solvent, and an aromatic hydrocarbon solvent.

(1-2) Charge Transport Layer

The charge transport layer preferably contains a charge transport material and a resin.

Examples of the charge transport material include a polynuclear aromatic compound, a heterocyclic compound, a hydrazone compound, a styryl compound, an enamine compound, a benzidine compound, and a triaryl amine compound, and resins having groups derived from these substances. Among them, the triaryl amine compound and the benzidine compound are preferred.

The content of the charge transport material in the charge transport layer is preferably 25% by mass or more to 70% by mass or less and more preferably 30% by mass or more to 55% by mass or less relative to the total mass of the charge transport layer.

Examples of the resin include a polyester resin, a polycarbonate resin, an acrylic resin, and a polystyrene resin. Among them, the polycarbonate resin and the polyester resin are preferred. As the polyester resin, a polyarylate resin is particularly preferred.

The content ratio (mass ratio) between the charge transport material and the resin is preferably from 0.4/1.0 to 2.0/1.0 and more preferably from 5.0/1.0 to 1.2/1.0.

Further, the charge transport layer may contain an additive such as an antioxidant, an ultraviolet absorber, a plasticizer, a leveling agent, a slipperiness-imparting agent, or an abrasion resistance improver. Specific examples thereof include a hindered phenol compound, a hindered amine compound, a sulfur compound, a phosphorus compound, a benzophenone compound, a siloxane-modified resin, a silicone oil, fluororesin particles, polystyrene resin particles, polyethylene resin particles, silica particles, alumina particles, and boron nitride particles.

The average thickness of the charge transport layer is preferably 5 μm or more to 50 μm or less, more preferably 8 μm or more to 40 μm or less, and particularly preferably 10 μm or more to 30 μm or less.

The charge transport layer can be formed by preparing a charge transport layer coating liquid containing the above materials and a solvent, forming a film of the coating liquid, and drying it. Examples of the solvent used for the coating liquid include an alcohol solvent, a ketone solvent, an ether solvent, an ester solvent, and an aromatic hydrocarbon solvent. Among these solvents, the ether solvent or the aromatic hydrocarbon solvent is preferred.

(2) Monolayer Photosensitive Layer

The monolayer photosensitive layer can be formed by preparing a photosensitive layer coating liquid containing a charge generation material, a charge transport material, a resin, and a solvent, forming a film of the coating liquid, and drying it. Examples of the charge generation material, the charge transport material, and the resin are the same as those exemplified in the materials in described in "(1) Layered Photosensitive Layer".

<Protective Layer>

In the present invention, a protective layer may be formed on the photosensitive layer. The protective layer is formed, thereby improving the durability.

The protective layer preferably contains conductive particles and/or a charge transport material, and a resin.

Examples of the conductive particles include metal oxide particles such as titanium oxide particles, zinc oxide particles, tin oxide particles, and indium oxide particles.

Examples of the charge transport material include a polynuclear aromatic compound, a heterocyclic compound, a hydrazone compound, a styryl compound, an enamine compound, a benzidine compound, and a triaryl amine compound, and resins having groups derived from these substances. Among them, the triaryl amine compound and the benzidine compound are preferred.

Examples of the resin include a polyester resin, an acrylic resin, a phenoxy resin, a polycarbonate resin, a polystyrene resin, a phenol resin, a melamine resin, and an epoxy resin. Among them, the polycarbonate resin, the polyester resin, and the acrylic resin are preferred.

Further, the protective layer may be formed as a cured film by polymerizing a composition containing a monomer having a polymerizable functional group. Examples of the reaction in the polymerization include a thermal polymerization reaction, a photopolymerization reaction, and a radiation polymerization reaction. Examples of the polymerizable functional group of the monomer having a polymerizable functional group include an acrylic group and a methacrylic group. As the monomer having a polymerizable functional group, a material having a charge transporting ability may be used.

The protective layer may contain an additive such as an antioxidant, an ultraviolet absorber, a plasticizer, a leveling agent, a slipperiness-imparting agent, or an abrasion resistance improver. Specific examples thereof include a hindered phenol compound, a hindered amine compound, a sulfur compound, a phosphorus compound, a benzophenone compound, a siloxane-modified resin, a silicone oil, fluororesin particles, polystyrene resin particles, polyethylene resin particles, silica particles, alumina particles, and boron nitride particles.

The average thickness of the protective layer is preferably 0.5 μm or more to 10 μm or less and more preferably 1 μm or more to 7 μm or less.

The protective layer can be formed by preparing a protective layer coating liquid containing the above materials and a solvent, forming a film of the coating liquid, and drying and/or curing it. Examples of the solvent used for the coating liquid include an alcohol solvent, a ketone solvent, an ether solvent, a sulfoxide solvent, an ester solvent, and an aromatic hydrocarbon solvent.

<Electrophotographic Apparatus>

In FIG. 1, a cylindrical electrophotographic photosensitive member 1 rotates about an axis 2 in an arrow direction (a clockwise direction) at a predetermined peripheral velocity (process speed). In a rotation process, the surface of the electrophotographic photosensitive member is uniformly charged at a predetermined positive or negative potential by a charging unit 3 (a primary charging unit: a charging roller etc.). Then, the electrophotographic photosensitive member 1 is irradiated with exposing light 4 which is reflected light from an original, that is output from an exposing unit (not illustrated) providing slit exposure or laser beam scanning exposure and that is intensity-modulated in accordance with a time-series electrical digital pixel signal of intended image information. Thus, an electrostatic latent image corresponding to the intended image information is sequentially formed on the surface of the electrophotographic photosensitive member 1.

Then, the electrostatic latent image formed on the surface of the electrophotographic photosensitive member 1 is developed (development or reversal development) with charged particles (toner) contained in a developer stored in a developing unit 5 to form a toner image.

After that, the toner image formed and held on the surface of the electrophotographic photosensitive member 1 is sequentially transferred to a transfer material 7 using a transfer bias from a transferring unit 6 (a transferring roller etc.). Here, the transfer material 7 is taken out from a transfer material feeding unit (not illustrated) in synchronization with the rotation of the electrophotographic photosensitive member 1 and fed between the electrophotographic photosensitive member 1 and the transferring unit 6 (contact part). Further, a bias voltage having a polarity reversal of the charge retained on the toner is applied to the transferring unit 6 from a bias power supply (not illustrated).

The transfer material 7 to which the toner image is transferred (in the case of a final transfer material (paper, a film, etc.) is separated from the surface of the electrophotographic photosensitive member and is transported to a fixing unit 8 for fixation of the toner image. Thus, an image formed object (print or copy) is printed out from an electrophotographic apparatus. When the transfer material 7 is an intermediate transfer body, it is subjected to fixation after a plurality of transferring steps and is printed out.

After transfer of the toner image, the surface of the electrophotographic photosensitive member 1 is cleaned by removal of attached material such as the remaining developer after transfer (remaining toner after transfer) with a cleaning unit 9 (a cleaning blade etc.). Recently, a cleanerless system has been studied, and the remaining toner after transfer may be directly removed with a development counter or the like. The surface of the electrophotographic photosensitive member 1 is de-charged by pre-exposing light from a pre-exposing unit 10 and the recovered toner is repeatedly used for forming images. Note that, as illustrated in FIG. 1, when the charging unit 3 is a contact charging unit using a charging roller etc., it is not necessarily necessary to perform pre-exposure.

In the present invention, a plurality of units out of the constituent elements such as the above electrophotographic photosensitive member 1, charging unit 3, developing unit 5, and cleaning unit 9 may be configured to be integrally combined together and placed in a container to form a process cartridge. Then, this process cartridge may be configured to be detachably attachable from the main body of an electrophotographic apparatus such as a copier or a laser beam printer. For example, at least one of the charging unit 3, the developing unit 5, and the cleaning unit 9 as well as the electrophotographic photosensitive member 1 is integrally supported to form a cartridge. Then, a guiding unit 12 such as a rail of the body of the apparatus is used, thereby forming a process cartridge 11 that is detachably attachable from the body of the apparatus.

The exposing light 4 is reflected light or transmitted light from an original when the electrophotographic apparatus is a copier or a printer. Alternatively, the exposing light 4 is emitted light produced by scanning of laser beams, driving of an LED array, or driving of a liquid crystal shutter array, in response to signals converted from data of the original read by a sensor.

According to the present invention, there is provided an electrophotographic photosensitive member in which the variation in potential is reduced after long-term repeated use.

According to the present invention, there are provided a process cartridge having the above electrophotographic photosensitive member and an electrophotographic apparatus.

EXAMPLES

Hereinafter, the present invention will be described more in detail with reference to Examples. However, the present invention is not limited to these examples. Note that the unit "part" used in Examples indicate "part by mass".

Example 1

As a support (conductive support), an aluminum cylinder having an outer diameter of 30 mm and a length of 357.5 mm was used. From the viewpoint of suppressing interference fringes, the surface of the used aluminum cylinder was previously ground with a lathe. The used cylinder was ground by changing the grinding conditions (the main-axis rotation speed (10000 rpm) and the speed of feeding the tool (0.03 to 0.06 mm/rpm) using the R0.1 tool.

Further, as the metal oxide particles, titanium oxide particles coated with the following inorganic silica 10% (hereinafter, referred to as "silica-coated titanium oxide particles") were used.

One hundred parts of titanium oxide particles (product name: TKP-101, manufactured by Tayca Corporation, number average particle diameter of primary particles: 6 nm) and 500 parts of toluene were stirred and mixed. To this solution, 1.2 parts of a silane coupling agent as a surface treatment agent (compound name: N-2-(aminoethyl)-3-aminopropylmethyldimethoxysilane, product name: KBM602, manufactured by Shin-Etsu Chemical Co., Ltd.) were added and the resultant mixture was stirred for 1 hour.

Thereafter, the toluene was distilled under reduced pressure, followed by drying by heating at 130° C. for 6 hours to form surface-treated and silica-coated titanium oxide particles.

Then, 0.5 parts of a butyral resin (product name: BM-1, manufactured by Sekisui Chemical Co., Ltd.) as a polyol resin and 0.5 parts of blocked isocyanate (product name: SUMIDULE 3175, manufactured by Sumitomo Bayer Urethane Co., Ltd.) were dissolved in a mixed solution of 10.5 parts of methanol and 3.5 parts of methoxy propanol.

To this solution, 2 parts of the surface-treated titanium oxide particles and 0.2 parts of a benzophenone compound (product name: 2,3,4-trihydroxy benzophenone, manufactured by Tokyo Chemical Industry Co., Ltd.) as an additive were added, and the resultant mixture was dispersed at 23±3° C. for 4 hours with a paint shaker using glass beads having a diameter of 0.8 mm.

After the dispersion, the glass beads were removed, 0.01 parts of silicone oil (product name: SH28PA, manufactured by Dow Corning Toray Co., Ltd.) was added to the dispersion solution, and the resultant mixture was stirred to prepare an undercoat layer coating liquid.

The above support was dip-coated with this undercoat layer coating liquid, and the resultant coating film was dried at 160° C. for 50 minutes to form an undercoat layer containing titanium oxide particles and a polyurethane resin and having a thickness of 2 μm.

Subsequently, 4 parts of hydroxy gallium phthalocyanine crystals (charge generation material) having strong peaks at Bragg angles 20±0.2° of 7.4° and 28.1° in the X-ray diffraction spectrum measured using a CuKα characteristic X-ray and 0.04 parts of the compound represented by Formula (3) below were added to a solution obtained by dissolving 2 parts of polyvinyl butyral (product name: S-LEC BX-1, manufactured by Sekisui Chemical Co., Ltd.) in 100 parts of cyclohexanone.

[Formula (3)]

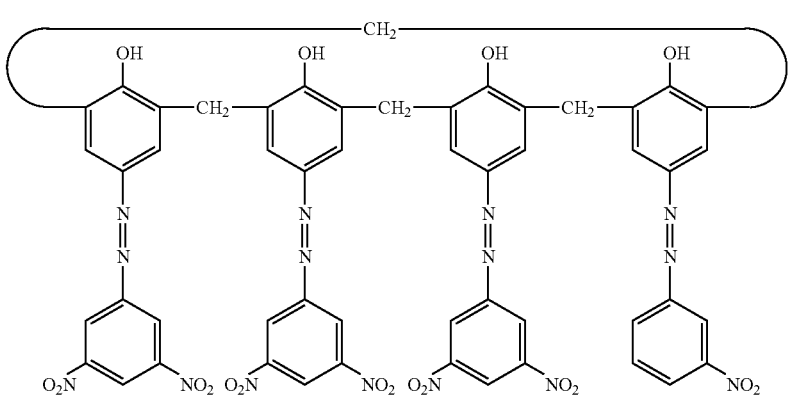

The resultant mixture was then dispersed with a sand mill using glass beads having a diameter of 1.0 mm at 23±3° C. for 1 hour. After the dispersion, 100 parts of ethyl acetate was added thereto, thereby preparing a charge generation layer coating liquid. The undercoat layer was dip-coated with this charge generation layer coating liquid, and the resultant coating film was dried at 90° C. for 10 minutes to form a charge generation layer having a thickness of 0.21 μm.

Then, 30 parts of the compound represented by Formula (4) below (a charge transport material), 60 parts of the compound represented by Formula (5) below (a charge transport material), 10 parts of the compound represented by Formula (6) below, 100 parts of polycarbonate (product name: Iupilon 2400, manufactured by Mitsubishi Engineering-Plastics Corporation, bisphenol Z type), and 0.02 parts of polycarbonate (viscosity average molecular weight Mv: 20000) having structural units represented by Formulae (7-1) and (7-2) were dissolved in a mixed solvent of 272 parts of o-xylene, 256 parts of methyl benzoate, and 272 parts of dimethoxymethane (methylal) to prepare a charge transport layer coating liquid. The charge generation layer was dip-coated with this charge transport layer coating liquid to form a coating film. The resultant coating film was dried at 115° C. for 50 minutes to form a charge transport layer having a thickness of 18 μm.

[Formulae (4), (5) and (6)]

(4)

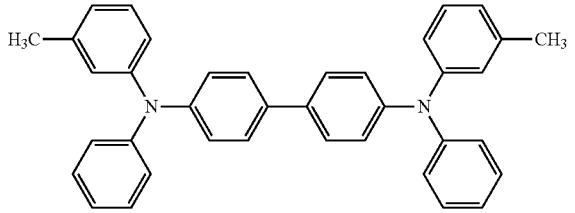

(5)

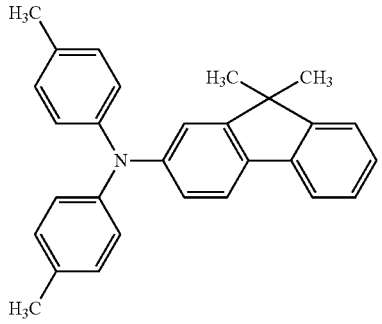

(6)

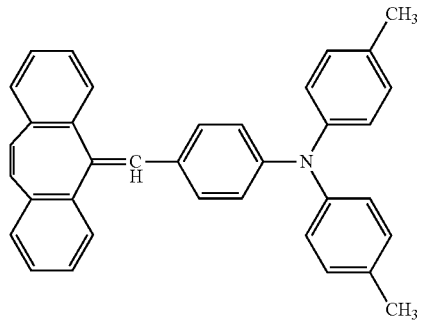

[Formulae (7-1) and (7-2)]

(7-1)

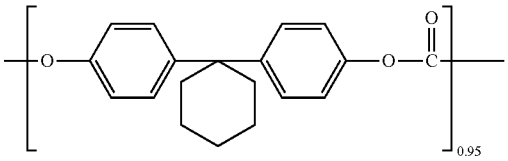

-continued (7-2)

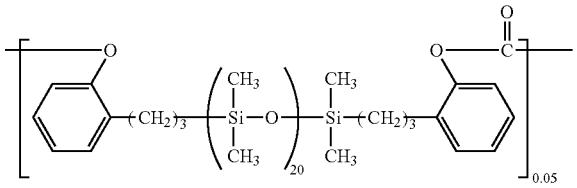

Then, 95 parts of the compound represented by Formula (8) below, 5 parts of a vinyl ester compound (manufactured by Tokyo Chemical Industry Co., Ltd.), i.e., the compound represented by Formula (9) below, 3.5 parts of a siloxane-modified acrylic compound (BYK-3550, manufactured by BYK Japan KK.), and 5 parts of a urea compound represented by Formula (10) below were dissolved in a mixed solvent of 200 parts of 1-propanol and 100 parts of 1,1,2,2,3,3,4-heptafluorocyclopentane (product name: ZEORORA H, manufactured by ZEON CORPORATION), and the resultant mixture was stirred.

Thereafter, this solution was filtered through a Polyflon filter (product name: PF-020, manufactured by Advantec Toyo Kaisha, Ltd.) to prepare a surface layer coating liquid (protective layer coating liquid).

[Formula (8)]

(8)

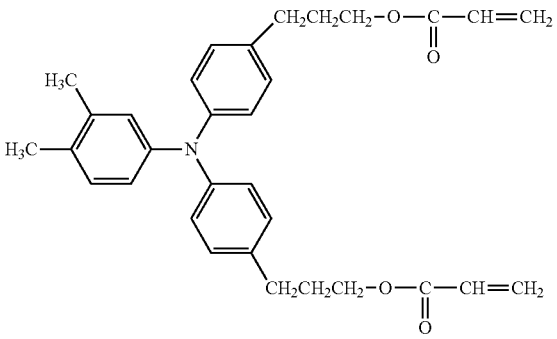

[Formula (9)]

(9)

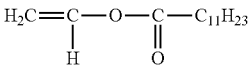

[Formula 10)]

(10)

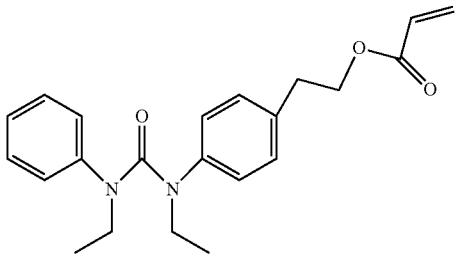

The charge transport layer was dip-coated with this surface layer coating liquid to form a coating film, and the resultant coating film was dried at 50° C. for 10 minutes. Thereafter, the coating film was irradiated with an electron beam for 1.6 seconds while a support (an object to be irradiated) was rotated at a speed of 200 rpm in a nitrogen atmosphere under the conditions (accelerating voltage of 70 kV, beam current of 5.0 mA). At this time, the absorbed dose of the electron beam was measured and it was 15 kGy. After that, the coating film was heated in a nitrogen atmosphere for 30 seconds until the temperature increased from 25° C. to 117° C. The oxygen concentration from the irradiation with the electron beam to the completion of the subsequent heat treatment was 15 ppm or less. Then, the coating film naturally cooled in the air until the temperature reached 25° C. The coating film was subjected to heat treatment for 30 minutes under the conditions where the temperature of the coating film reached 105° C., thereby forming a 5-μm thick protective layer (a surface layer).

It is contemplated that the surface of the produced electrophotographic photosensitive member is subjected to surface processing in order to reduce a frictional force of the member which may abut on the surface of the photoconductor. Examples of the surface processing include polishing processing and pattern processing.

In Example 1, the pattern processing was performed. In the pattern processing, concave portions are formed by transferring mold pressed patterns.

[Formation of Concave Portions by Mold Pressure Pattern Transferring]

A die member (mold) is placed on a pressure pattern transferring apparatus, followed by surface processing of the electrophotographic photosensitive member with the protective layer formed thereon before formation of concave portions.

Figure 3:
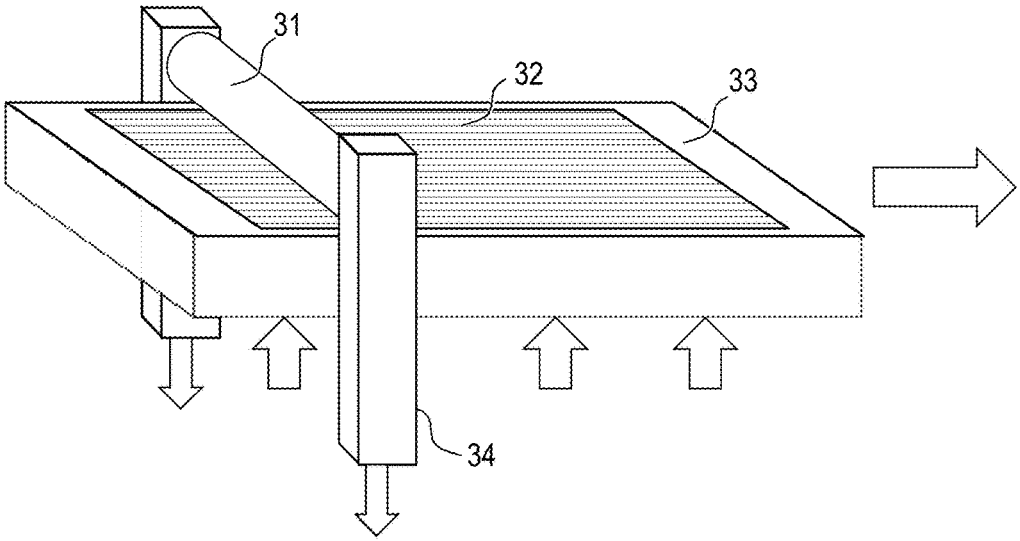
FIG. 3 is a view illustrating an example of a pressure pattern transferring apparatus used to form concave portions on a peripheral surface of the electrophotographic photosensitive member.
Figure 4A:
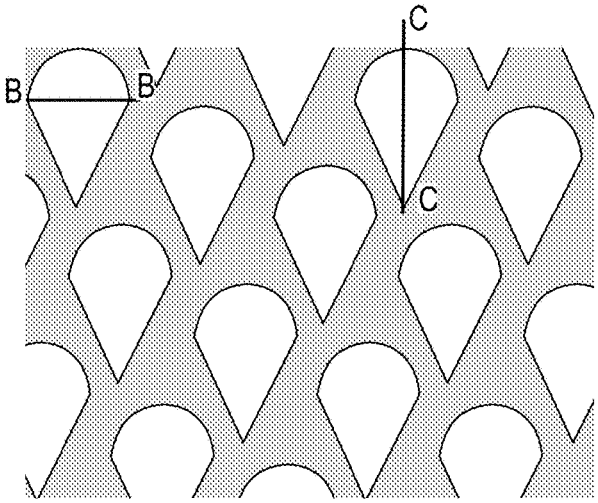
FIG. 4A is a top view illustrating a mold used in Example 1 of the electrophotographic photosensitive member.
Figure 4B:
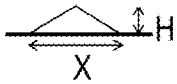
FIG. 4B is a B-B cross sectional view of a protrusion in the mold illustrated in FIG. 4A.
Figure 4C:
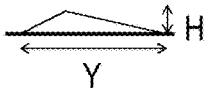
FIG. 4C is a C-C cross sectional view of a protrusion in the mold illustrated in FIG. 4A.

As illustrated in FIG. 3, on a pressure pattern transferring apparatus having a mold 32, a pressing member 33, and a support member 34, a mold having any of the shapes illustrated in FIGS. 4A to 4C (in this example, the maximum width, i.e., the maximum axis directional width when the protrusion on the mold is seen from the top side; hereafter the same shall apply.) X: 30 μm, the maximum length, i.e., the maximum peripheral length when the protrusion on the mold is seen from the top side; hereafter the same shall apply.) Y: 75 μm, area rate of 60%, height H: 1.0 μm protrusion) was placed, followed by processing of a peripheral surface of an electrophotographic photosensitive member 31 before the surface treatment. At the time of processing, the temperature of the electrophotographic photosensitive member and the temperature of the mold were controlled so that the temperature of the peripheral surface of the electrophotographic photosensitive member was 120° C. While pressing the electrophotographic photosensitive member against the pressing member at 7.0 MPa, the electrophotographic photosensitive member was rotated in a circumferential direction, thereby forming concave portions on the whole peripheral surface of the electrophotographic photosensitive member.

The electrophotographic photosensitive member of Example 1 was produced in the above manner.

Example 2

An electrophotographic photosensitive member was produced in the same manner as in Example 1 except that, in Example 1, the kind of the additive used to prepare the undercoat layer coating liquid was changed from a benzophenone compound to an alizarin compound (product name: 1,2-dihydroxyanthraquinone, manufactured by Tokyo Chemical Industry Co., Ltd.) as shown in Table 1. In Table 1, the benzophenone compound is represented by BP.

Examples 3 to 5

Electrophotographic photosensitive members were produced in the same manner as in Example 1 except that, in Example 1, the kind and amount of each solvent used to prepare the undercoat layer coating liquid were changed as shown in Table 1.

Examples 6 to 8

Electrophotographic photosensitive members were produced in the same manner as in Example 1 except that, in Example 1, the kind and amount of each surface treatment agent of the titanium oxide particles used to prepare the undercoat layer coating liquid were changed as shown in Table 1.

Example 9

An electrophotographic photosensitive member was produced in the same manner as in Example 1 except that, in Example 1, the titanium oxide particles used to prepare the undercoat layer coating liquid (product name: AMT-100, manufactured by TAYCA CORPORATION, number average particle diameter of primary particles: 6 nm).

Examples 10, 11, and 12

Electrophotographic photosensitive members were produced in the same manner as in Example 1 except that, in Example 1, each number average particle diameter of the titanium oxide primary particles used to prepare the undercoat layer coating liquid was adjusted as shown in Table 1.

Examples 13 and 14

Electrophotographic photosensitive members were produced in the same manner as in Example 1 except that, in Example 1, each mass ratio between the metal oxide (P) used to prepare the undercoat layer coating liquid and the binder resin (B) was adjusted as shown in Table 1.

Examples 15, 16, 25, 26, and 27

Electrophotographic photosensitive members were produced in the same manner as in Example 1 except that, in Example 1, each thickness after drying of the coated undercoat layer was adjusted as shown in Table 1.

Example 17

An electrophotographic photosensitive member was produced in the same manner as in Example 1 except that, in Example 1, the method of processing a surface layer was changed to a polishing method as described below.

[Polishing of Electrophotographic Photosensitive Member Before Surface Processing]

Figure 5:
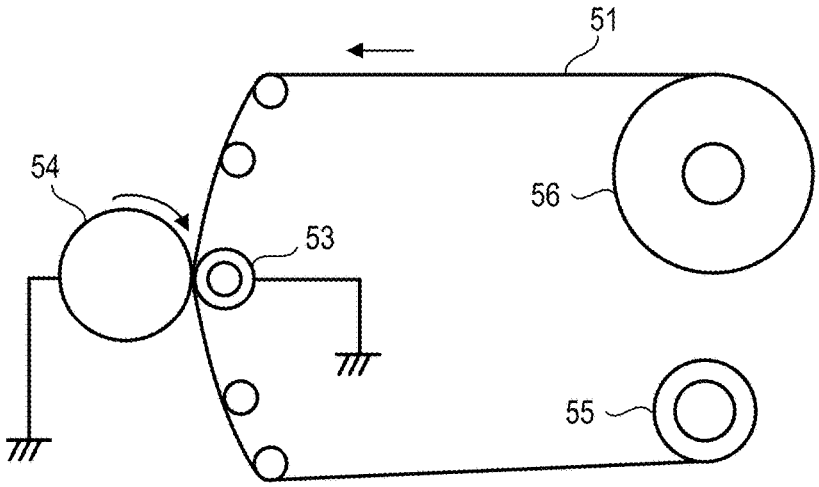
FIG. 5 illustrates an apparatus for polishing a cylindrical electrophotographic photosensitive member using a polishing sheet.

The surface of the electrophotographic photosensitive member before surface processing was polished. Polishing was performed using a polisher of FIG. 5 under the following conditions:

Speed of feeding a polishing sheet 51; 400 mm/min,

Rotation speed of an electrophotographic photosensitive member 54 before processing; 450 rpm, Pushing of the electrophotographic photosensitive member 54 before processing into a backup roller 53; 3.5 mm, Rotation direction of the polishing sheet 51 and the electrophotographic photosensitive member, and Backuproller 53; outer diameter of 100 mm, Asker C hardness of 25.

The polishing sheet 51 to be attached to the polisher was produced using a mixture of polishing abrasive used for GC3000 and GC2000 (manufactured by Riken Corundum Co., Ltd.).

GC3000 (surface roughness Ra of the polishing sheet: 0.83 μm)

GC2000 (surface roughness Ra of the polishing sheet: 1.45 μm)

The polishing sheet 51 (surface roughness Ra of the polishing sheet: 1.12 μm)

The polishing time using the polishing sheet 51 was set to 20 seconds.

Examples 18

An electrophotographic photosensitive member was produced in the same manner as in Example 1 except that, in Example 1, no surface layer (protective layer) was formed and the charge transport layer was changed as follows:

Seventy two parts of the compound represented by Formula (5) above (charge transport material), 8 parts of the compound represented by Formula (6) above (charge transport material), 100 parts of the resin represented by Formula (11) blow, and 1.8 parts of the resin having the structure represented by Formula (12) below were dissolved in a mixed solvent of 360 parts of o-xylene, 160 parts of methyl benzoate, and 270 parts of dimethoxymethane (methylal) to form a charge transport layers coating liquid.

Then, the charge generation layer was dip-coated with the resultant charge transport layer coating liquid. The resultant coating film was dried at 125° C. for 50 minutes to form a charge transport layer having a thickness of 20 μm.

[Formula (11)]

(11)

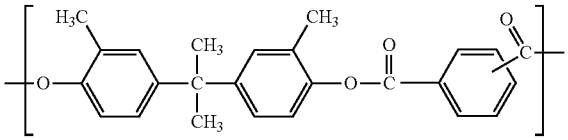

[Formula (12)]

(12)

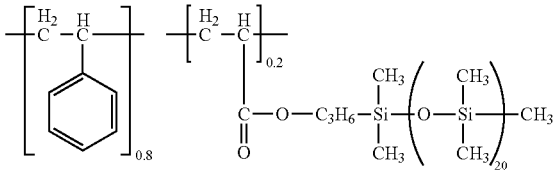

Examples 19

An electrophotographic photosensitive member was produced in the same manner as in Example 1 except that, in Example 1, the following honing cylinder was used as a photosensitive layer-forming support.

A cylindrical aluminum cylinder (JIS-A3003, an aluminum alloy with a diameter of 30 mm, a length of 357.5 mm, and a thickness of 0.7 mm) was placed in a lathe, and the cylinder was ground with a sintered diamond tool so as to achieve the following conditions: outer diameter: 30.0±0.02 mm; deflection precision: 15 μm; and surface roughness Rz=0.2 μm. At this time, the main-axis rotation speed was 3000 rpm, the speed of feeding the tool was 0.3 mm/rev, and the processing time except the detachment of the work was 24 seconds.

The surface roughness was measured at a cutoff of 0.8 mm and a measurement length of 8 mm using a surface roughness tester (Surf-Coder SE3500, manufactured by Kosaka Laboratory Ltd.) in accordance with JIS B 0601.

The resultant ground aluminum tube was subjected to liquid honing treatment using a liquid (wet) honing device under the following liquid honing conditions:

<Liquid Honing Conditions>

Abrasive grain of polishing material: spherical alumina beads having an average particle diameter of 30 μm (product name: CB-A 30S, manufactured by Showa Denko K.K.)

Suspension medium: water;

Polishing material/suspending medium: 1/9 (volume ratio);

Rotation speed of ground aluminum tube: 1.67 $S^{-1}$;

Air-blowing pressure: 0.15 MPa; Gun moving speed: 13.3 mm/sec.;

Distance between gun nozzle and aluminum tube: 200 mm,

Honing abrasive grain discharging angle: 45°; and

Number of times of projection of polishing liquid: once (one way).

The surface roughness of the cylinder after honing was as follows: Rmax=2.53 μm, Rz=1.51 μm, Ra=0.23 μm, and Sm=34 μm. The aluminum cylinder immediately after being subjected to wet honing in the above manner was once immersed in an immersion tank containing pure water and pulled up. Before the cylinder was dried up, the cylinder was cleaned by showering with pure water. Thereafter, warm water at 85° C. was discharged to and brought into contact with the inner surface of the substrate from a discharge nozzle, thereby drying the outer surface. After that, the inner surface of the substrate was dried by natural drying.

The thus surface-treated aluminum cylinder was used as a support of the electrophotographic photosensitive member.

Examples 20

An electrophotographic photosensitive member was produced in the same manner as in Example 1 except that, in Example 1, an aluminum cylinder having the following conductive layer formed on a photosensitive layer-forming support was used. In Table 1, the aluminum cylinder having the following conductive layer formed is indicated as "CP-complete-drum".

Fifty seven parts of titanium oxide particles (product name: Pastoran LRS, manufactured by Mitsui Mining & Smelting Co., Ltd.) having the covering layer, 35 parts of a resol phenol resin (product name: Ferrite J-325, manufactured by DIC Corporation (former Dainippon Ink and Chemicals), a methanol solution with a solid content of 60%), and 33 parts of 2-methoxy-1-propanol were mixed, and the resultant mixture was dispersed with a sand mill using glass beads having a diameter of 1.0 mm for 3 hours to prepare a conductive layer dispersion solution. The powder contained in the dispersion solution had an average particle diameter of 0.30 μm. To this dispersion solution, a solution obtained by dispersing 8 parts of a silicone resin (product name: Tospearl 120, manufactured by Momentive Performance Materials Inc. (former Toshiba Silicone, Co., Ltd.) in 8 parts of 2-methoxy-1-propanol was added. Further, 0.008 parts of silicone oil (product name: SH28PA, manufactured by Dow Corning Toray Co., Ltd. (former Toray Industries, Inc.) was used. The thus prepared dispersion solution was applied to an aluminum cylinder, i.e., a support, by the dip coating method. The aluminum cylinder was placed in a hot-air drying machine adjusted to 150° C. for 30 minutes so that the coating film of the dispersion solution was thermally cured, and thus a conductive layer having a thickness of 30 μm was formed.

Examples 21

Electrophotographic photosensitive members were produced in the same manner as in Example 1 except that, in Example 1, the kind and amount of each surface treatment agent of the titanium oxide particles used to prepare the undercoat layer coating liquid were changed as shown in Table 1.

Examples 22

An electrophotographic photosensitive member was produced in the same manner as in Example 1 except that, in Example 1, the benzophenone compound was not added as the additive.

Examples 23 and 24

Electrophotographic photosensitive members were produced in the same manner as in Example 1 except that, in Example 1, each ratio of the metal oxide (P) used to prepare the undercoat layer coating liquid and the binder resin (B) was changed as shown in Table 1.

Comparative Example 1

An electrophotographic photosensitive member was produced in the same manner as in Example 1 except that, in Example 1, the surface treatment method of the titanium oxide particles used to prepare the undercoat layer coating liquid, the kinds of the binder resin and the solvent, and the mixing ratio therebetween were changed as follows:

Titanium oxide particles treated with 15% inorganic silica (product name: TKP-101, manufactured by TAYCA CORPORATION, number average particle diameter of primary particles: 6 nm) were used.

Ten parts of an N-methoxymethylated 6-nylon resin (product name: Toresin EF-30T, manufactured by NagaseChemteX Corporation, methoxymethylation ratio: 28 to 33% by mass) was dissolved in 90 parts of methanol to prepare a solution. This prepared solution and 1-butanol were used at a ratio of 2:1 (mass ratio).

Comparative Example 2

An electrophotographic photosensitive member was produced in the same manner as in Example 1 except that, in Example, the number average particle diameter of the titanium oxide primary particles used to prepare the undercoat layer coating liquid was changed to 35 nm.

Comparative Examples 3 and 4

Electrophotographic photosensitive members were produced in the same manner as in Example 1 except that, in Example 1, the number average particle diameters of the secondary particles of the titanium oxide used to prepare the undercoat layer coating liquid were adjusted to 150 nm and 600 nm, respectively.

TABLE 1

| | Titanium oxide particles | | | Binder resin | Oxide/resin | Mixed solvent | | |
|---|---|---|---|---|---|---|---|---|
| | Primary particle diameter (nm) | Secondary particle diameter (nm) | Surface treatment | Kind | Ratio | Solvent 1 | Solvent 2 | Ratio |
| Example 1 | 6 nm | 400 nm | bi-functional aminosilane 10% | Urethane resin | 2:1 | Methanol | Methoxy propanol | 3:1 |
| Example 2 | 6 nm | 400 nm | bi-functional aminosilane 10% | Urethane resin | 2:1 | Methanol | Methoxy propanol | 3:1 |
| Example 3 | 6 nm | 500 nm | bi-functional aminosilane 10% | Urethane resin | 2:1 | MEK | 1-butanol | 1:1 |
| Example 4 | 6 nm | 500 nm | bi-functional aminosilane 10% | Urethane resin | 2:1 | Methanol | Methoxy propanol | 1:1 |
| Example 5 | 6 nm | 400 nm | bi-functional aminosilane 10% | Urethane resin | 2:1 | Methanol | Methoxy propanol | 2:1 |
| Example 6 | 6 nm | 500 nm | bi-functional aminosilane 5% | Urethane resin | 2:1 | Methanol | Methoxy propanol | 3:1 |
| Example 7 | 6 nm | 200 nm | bi-functional aminosilane 20% | Urethane resin | 2:1 | Methanol | Methoxy propanol | 3:1 |
| Example 8 | 6 nm | 400 nm | tri-functional aminosilane 10% | Urethane resin | 2:1 | Methanol | Methoxy propanol | 3:1 |
| Example 9 | 6 nm | 400 nm | bi-functional aminosilane 10% | Urethane resin | 2:1 | Methanol | Methoxy propanol | 3:1 |
| Example 10 | 1 nm | 500 nm | bi-functional aminosilane 10% | Urethane resin | 2:1 | Methanol | Methoxy propanol | 3:1 |
| Example 11 | 3 nm | 400 nm | bi-functional aminosilane 10% | Urethane resin | 2:1 | Methanol | Methoxy propanol | 3:1 |
| Example 12 | 10 nm | 200 nm | bi-functional aminosilane 10% | Urethane resin | 2:1 | Methanol | Methoxy propanol | 3:1 |
| Example 13 | 6 nm | 500 nm | bi-functional aminosilane 10% | Urethane resin | 1:1 | Methanol | Methoxy propanol | 3:1 |

TABLE 1-continued

| | | | | | | | | |
|---|---|---|---|---|---|---|---|---|
| Example 14 | 6 nm | 300 nm | bi-functional aminosilane 10% | Urethane resin | 3:1 | Methanol | Methoxy propanol | 3:1 |
| Example 15 | 6 nm | 400 nm | bi-functional aminosilane 10% | Urethane resin | 2:1 | Methanol | Methoxy propanol | 3:1 |
| Example 16 | 6 nm | 400 nm | bi-functional aminosilane 10% | Urethane resin | 2:1 | Methanol | Methoxy propanol | 3:1 |
| Example 17 | 6 nm | 400 nm | bi-functional aminosilane 10% | Urethane resin | 2:1 | Methanol | Methoxy propanol | 3:1 |
| Example 18 | 6 nm | 400 nm | bi-functional aminosilane 10% | Urethane resin | 2:1 | Methanol | Methoxy propanol | 3:1 |
| Example 19 | 6 nm | 400 nm | bi-functional aminosilane 10% | Urethane resin | 2:1 | Methanol | Methoxy propanol | 3:1 |
| Example 20 | 6 nm | 400 nm | bi-functional aminosilane 10% | Urethane resin | 2:1 | Methanol | Methoxy propanol | 3:1 |
| Example 21 | 6 nm | 500 nm | Vinylsilane 10% | Urethane resin | 2:1 | Methanol | Methoxy propanol | 3:1 |
| Example 22 | 6 nm | 400 nm | bi-functional aminosilane 10% | Urethane resin | 2:1 | Methanol | Methoxy propanol | 3:1 |
| Example 23 | 6 nm | 500 nm | bi-functional aminosilane 10% | Urethane resin | 0.5:1 | Methanol | Methoxy propanol | 3:1 |
| Example 24 | 6 nm | 300 nm | bi-functional aminosilane 10% | Urethane resin | 4:1 | Methanol | Methoxy propanol | 3:1 |
| Example 25 | 6 nm | 400 nm | bi-functional aminosilane 10% | Urethane resin | 2:1 | Methanol | Methoxy propanol | 3:1 |
| Example 26 | 6 nm | 400 nm | bi-functional aminosilane 10% | Urethane resin | 2:1 | Methanol | Methoxy propanol | 3:1 |
| Example 27 | 6 nm | 400 nm | bi-functional aminosilane 10% | Urethane resin | 2:1 | Methanol | Methoxy propanol | 3:1 |
| Comparative Example 1 | 6 nm | 500 nm | Treatment with inorganic silica | Nylon resin | 3:1 | Methanol | 1-butanol | 2:1 |
| Comparative Example 2 | 35 nm | 500 nm | bi-functional aminosilane 10% | Urethane resin | 2:1 | Methanol | Methoxy propanol | 3:1 |
| Comparative Example 3 | 6 nm | 150 nm | bi-functional aminosilane 10% | Urethane resin | 2:1 | Methanol | Methoxy propanol | 3:1 |
| Comparative Example 4 | 6 nm | 600 nm | bi-functional aminosilane 10% | Urethane resin | 2:1 | Methanol | Methoxy propanol | 3:1 |

| | Electron-beam-cured film | Type of cylinder | Additive | Film thickness |
|---|---|---|---|---|
| Example 1 | Pattern processing: performed | Grinding treatment | Silicone oil + BP | 2 μm |
| Example 2 | Pattern processing: performed | Grinding treatment | Silicone oil + alizarin | 2 μm |
| Example 3 | Pattern processing: performed | Grinding treatment | Silicone oil + BP | 2 μm |
| Example 4 | Pattern processing: performed | Grinding treatment | Silicone oil + BP | 2 μm |
| Example 5 | Pattern processing: performed | Grinding treatment | Silicone oil + BP | 2 μm |
| Example 6 | Pattern processing: performed | Grinding treatment | Silicone oil + BP | 2 μm |
| Example 7 | Pattern processing: performed | Grinding treatment | Silicone oil + BP | 2 μm |
| Example 8 | Pattern processing: performed | Grinding treatment | Silicone oil + BP | 2 μm |
| Example 9 | Pattern processing: performed | Grinding treatment | Silicone oil + BP | 2 μm |
| Example 10 | Pattern processing: performed | Grinding treatment | Silicone oil + BP | 2 μm |
| Example 11 | Pattern processing: performed | Grinding treatment | Silicone oil + BP | 2 μm |
| Example 12 | Pattern processing: performed | Grinding treatment | Silicone oil + BP | 2 μm |
| Example 13 | Pattern processing: performed | Grinding treatment | Silicone oil + BP | 2 μm |
| Example 14 | Pattern processing: performed | Grinding treatment | Silicone oil + BP | 2 μm |
| Example 15 | Pattern processing: performed | Grinding treatment | Silicone oil + BP | 5 μm |
| Example 16 | Pattern processing: performed | Grinding treatment | Silicone oil + BP | 10 μm |
| Example 17 | Polishing processing: performed | Grinding treatment | Silicone oil + BP | 2 μm |
| Example 18 | No electron-beam-cured film | Grinding treatment | Silicone oil + BP | 2 μm |
| Example 19 | Pattern processing: performed | Honing treatment | Silicone oil + BP | 2 μm |
| Example 20 | Pattern processing: performed | CP-complete-drum | Silicone oil + BP | 2 μm |

TABLE 1-continued

| | | | | |
|---|---|---|---|---|
| Example 21 | Pattern processing: performed | Grinding treatment | Silicone oil + BP | 2 μm |
| Example 22 | Pattern processing: performed | Grinding treatment | Silicone oil | 2 μm |
| Example 23 | Pattern processing: performed | Grinding treatment | Silicone oil + BP | 2 μm |
| Example 24 | Pattern processing: performed | Grinding treatment | Silicone oil + BP | 2 μm |
| Example 25 | Pattern processing: performed | Grinding treatment | Silicone oil + BP | 0.5 μm |
| Example 26 | Pattern processing: performed | Grinding treatment | Silicone oil + BP | 18 μm |
| Example 27 | Pattern processing: performed | Grinding treatment | Silicone oil + BP | 30 μm |
| Comparative Example 1 | Pattern processing: performed | Grinding treatment | Silicone oil + BP | 2 μm |
| Comparative Example 2 | Pattern processing: performed | Grinding treatment | Silicone oil + BP | 2 μm |
| Comparative Example 3 | Pattern processing: performed | Grinding treatment | Silicone oil + BP | 2 μm |
| Comparative Example 4 | Pattern processing: performed | Grinding treatment | Silicone oil + BP | 2 μm |

<Evaluation>

The method of evaluating the electrophotographic photosensitive members of Examples 1 to 27 and Comparative Examples 1 to 4 is as follows:

<Variation in Potential>

Two evaluation devices were provided.

One of them was a copier (product name: IR-ADV C5560F, manufactured by Canon, Inc.). The (primary) charging unit is a rubber roller contact charger (a charging roller) that uses a current obtained by superimposing an alternating current on a direct current. The exposing unit is an image exposing unit with a laser, and the developing unit is a noncontact developing system that uses single-component magnetic negative toner. The transferring unit was a belt-type contact transferring system. As the cleaning unit, a cleaner in which a rubber blade was disposed in a counter direction relative to the rotation direction of the photoconductor was used. As the pre-exposing unit, a pre-exposing unit (that uses an LED) was used. Each of the electrophotographic photosensitive members of Examples 1 to and Comparative Examples 1 to 4 was placed in the evaluation device.

The above evaluation device was placed in an environment of 23° C. and 50% RH. The alternating component of a charging roller was set to be 1500 Vpp and 1500 Hz, the direct component was set to be −550 V, and an initial dark potential (Vda) before a long-term durability test was set to be −550 V. Further, each of the electrophotographic photosensitive members was adjusted so that an initial light potential (Vla) before a long-term durability test through exposure with a 780-nanometer laser had a value of −200 V in each of the electrophotographic photosensitive members.

The other was a copier (product name: IR-ADV C 3330F, manufactured by Canon, Inc.). The (primary) charging unit is a rubber roller contact charger (a charging roller) that uses a current obtained by applying a direct current. The exposing unit is an image exposing unit with a laser, and the developing unit is a noncontact developing system that uses single-component magnetic negative toner. The transferring unit was a belt-type contact transferring system. As the cleaning unit, a cleaner in which a rubber blade was disposed in a counter direction relative to the rotation direction of the photoconductor was used. As the pre-exposing unit, a pre-exposing unit (that uses an LED) was used. Each of the electrophotographic photosensitive members of Examples 1 to 27 and Comparative Examples 1 to 4 was placed in the evaluation device.

The above evaluation device was placed in an environment of 23° C. and 50% RH. The direct component of the charging roller was set to be −1300 V and the initial dark potential (Vda) before the repeated use test was adjusted to −700 V. Further, each of the electrophotographic photosensitive members was adjusted so that an initial light potential (Vla) before a long-term durability test through exposure with a 780-nanometer laser had a value of −200 V in each of the electrophotographic photosensitive members.

The surface potential of the electrophotographic photosensitive member was measured by removing a developing cartridge from each evaluation device and inserting a potential measurement device therein. The potential measurement device includes a potential measurement probe disposed at a development position of the developing cartridge. The potential measurement probe was provided in the center of the drum-shaped electrophotographic photosensitive member in the axial direction while being 3 mm away from the surface of the electrophotographic photosensitive member.

Subsequently, evaluations were performed in accordance with (1) and (2) below. Note that the evaluations (1) and (2) were performed without changing the initial conditions of the alternating component/direct component and the initial exposure conditions of each of the electrophotographic photosensitive members. The evaluations were performed after each of the electrophotographic photosensitive members was left to stand in an environment of 23° C. and 50% RH for 48 hours to allow each of the electrophotographic photosensitive members to adapt to the environment.

(1) The electrophotographic photosensitive member and the potential measurement device were installed in the evaluation device, and measurements were performed on the following potentials:

an initial dark potential (Vda); and an initial light potential (Vla).

(2) A short-term durability test equivalent to the printing of 999 sheets was performed and measurements were performed on the following potentials:

a dark potential (Vdb) at the time the printing equivalent to the 999th sheet; and a light potential (Vlb) at the time the printing equivalent to the 999th sheet.

Then, variations in the dark and light potentials were calculated, and the resultant variations were referred to as "dark potential variation ΔVd (ab) and "light potential variation ΔVl (ab)", respectively.

Initial dark potential (*Vda*)−dark potential (*Vdb*) at the time the printing equivalent to the 999th sheet=dark potential variation Δ*Vd* (*ab*)

Initial light potential (*Vla*)−light potential (*Vlb*) at the time the printing equivalent to the 999th sheet=light potential variation Δ*Vl* (*ab*)

ΔVd (ab) and AVl (ab) were evaluated as the following criteria: A: ±10 V or less;

B: ±15 V or less; and

C: larger than 15 V.

<Dispersibility>

The undercoat layer coating liquid was dispersed with a paint shaker, and a dilute solution of the dispersion solution was measured using a particle diameter analyser (product name: ZETASIZER Nano-S, manufactured by Malvern Instruments Ltd.). The measured particle diameter was used as an indicator of the dispersed particle diameter before coating. In the measurement, the dilute solution was the solvent used when producing the undercoat layer coating liquid (at the solvent ratio at the time of production). The primary and secondary particle diameters of the titanium oxide particles in the undercoat layer were measured by applying the coating liquid to the cylinder, drying it to form an electrophotographic photosensitive member, observing the cross section of the undercoat layer using a scanning electron microscope (SEM, SU8000, manufactured by Hitachi High-Technologies Corporation.).

The primary particle diameter of the titanium oxide particles dispersed in the undercoat layer and the secondary particle diameter of the aggregated titanium oxide particles are determined by the following method. First, the cross section of the undercoat layer is photographed by SEM. The photographed cross section is mapped with an element of the titanium oxide particles using an X-ray microanalyser (XMA) attached to the SEM, and the photographed cross section is compared to the cross section of the undercoat layer. The projected area of the titanium oxide primary particles present per unit is measured. The diameter equivalent to one of a circle that has an area equal to the measured projected area of each the metal oxide particles is determined as the primary particle diameter of each of the titanium oxide particles. Based on the results, the number average primary particle diameter of the titanium oxide particles present per unit area is calculated.

Similarly, regarding the secondary particle diameter, the projected area of each of the aggregated titanium oxide particles (secondary particles) is measured from the photographed cross section after being mapped with an element. The diameter equivalent to one of a circle that has an area equal to the measured projected area of each of the titanium oxide secondary particles is determined as the secondary particle diameter of each of the titanium oxide particles. Based on the results, the number average particle diameter of the titanium oxide secondary particles present per unit area is calculated. Tables 1 and 2 show the number average particle diameter of primary particles and the number average particle diameter of secondary particles regarding the electrophotographic photosensitive members of Examples 1 to 27 and Comparative Examples 1 to 4 produced by the above method. The dispersibility was evaluated according the following criteria:

A: the number average particle diameter of secondary particles was 400 nm or less;

B: the number average particle diameter of secondary particles was larger than 400 nm and 500 nm or less; and C: the number average particle diameter of secondary particles was larger than 500 nm.

<Adhesion>

The adhesion of the undercoat layer was evaluated using a Fischerscope hardness tester (product name: FISCHERSCOPE HM2000LT). The terminal of the penetrator of the hardness tester was loaded on the surface of a photoconductor drum at 2000 mN for 20 seconds, and the trace of the penetrator on the surface of the photoconductor after unloading was observed with a laser microscope (product name: VK-X100, manufactured by KEYENCE CORPORATION.). When the adhesion is poor and peeling between the undercoat layer and the photosensitive layer occurs, interference fringes around the trace of the penetrator are observed due to the lifting of the photosensitive layer. The electrophotographic photosensitive members of Examples 1 to 24 and Comparative Examples 1 to 4 were evaluated by comparing the areas of the interference fringes.

The area of interference fringe was evaluated as the following criteria:

A: the diameter was 100 μm or less;

B: the diameter was 200 μm or less; and

C: the diameter was larger than 200 μm.

The electrophotographic photosensitive members of Examples 1 to 27 and Comparative Examples 1 to 4 were evaluated and compared from the viewpoints of the dispersibility, variation in potential, and adhesion. The results are shown in Table 2.

As the evaluation results, the variation in potential was sufficiently reduced during repeated use and other image problems such as black spots were not caused in the examples. However, image defects due to the variation in potential (such as deterioration in concentration and black spots) were caused in the comparative examples.

TABLE 2

| | Titanium oxide particles | | | | Evaluation result | | |
|---|---|---|---|---|---|---|---|
| | Primary particle diameter (nm) | Secondary particle diameter (nm) | Surface treatment | Binder resin Kind | Dispersibility | Adhesion | Variation in potential |
| Example 1 | 6 nm | 400 nm | bi-functional aminosilane 10% | Urethane resin | A | A | A |
| Example 2 | 6 nm | 400 nm | bi-functional aminosilane 10% | Urethane resin | A | A | A |
| Example 3 | 6 nm | 500 nm | bi-functional aminosilane 10% | Urethane resin | B | A | A |
| Example 4 | 6 nm | 500 nm | bi-functional aminosilane 10% | Urethane resin | B | A | A |
| Example 5 | 6 nm | 400 nm | bi-functional aminosilane 10% | Urethane resin | A | A | A |

TABLE 2-continued

| | Titanium oxide particles | | | | Evaluation result | | |
|---|---|---|---|---|---|---|---|
| | Primary particle diameter (nm) | Secondary particle diameter (nm) | Surface treatment | Binder resin Kind | Dispersibility | Adhesion | Variation in potential |
| Example 6 | 6 nm | 500 nm | bi-functional aminosilane 5% | Urethane resin | B | A | A |
| Example 7 | 6 nm | 200 nm | bi-functional aminosilane 20% | Urethane resin | A | A | A |
| Example 8 | 6 nm | 400 nm | tri-functional aminosilane 10% | Urethane resin | A | A | A |
| Example 9 | 6 nm | 400 nm | bi-functional aminosilane 10% | Urethane resin | A | A | A |
| Example 10 | 1 nm | 500 nm | bi-functional aminosilane 10% | Urethane resin | B | A | B |
| Example 11 | 3 nm | 400 nm | bi-functional aminosilane 10% | Urethane resin | A | A | A |
| Example 12 | 10 nm | 200 nm | bi-functional aminosilane 10% | Urethane resin | A | A | B |
| Example 13 | 6 nm | 500 nm | bi-functional aminosilane 10% | Urethane resin | B | A | A |
| Example 14 | 6 nm | 300 nm | bi-functional aminosilane 10% | Urethane resin | A | A | A |
| Example 15 | 6 nm | 400 nm | bi-functional aminosilane 10% | Urethane resin | A | A | A |
| Example 16 | 6 nm | 400 nm | bi-functional aminosilane 10% | Urethane resin | A | A | A |
| Example 17 | 6 nm | 400 nm | bi-functional aminosilane 10% | Urethane resin | A | A | A |
| Example 18 | 6 nm | 400 nm | bi-functional aminosilane 10% | Urethane resin | A | A | A |
| Example 19 | 6 nm | 400 nm | bi-functional aminosilane 10% | Urethane resin | A | A | A |
| Example 20 | 6 nm | 400 nm | bi-functional aminosilane 10% | Urethane resin | A | A | A |
| Example 21 | 6 nm | 500 nm | Vinylsilane 10% | Urethane resin | B | A | B |
| Example 22 | 6 nm | 400 nm | bi-functional aminosilane 10% | Urethane resin | A | B | B |
| Example 23 | 6 nm | 500 nm | bi-functional aminosilane 10% | Urethane resin | B | A | B |
| Example 24 | 6 nm | 300 nm | bi-functional aminosilane 10% | Urethane resin | A | B | B |
| Example 25 | 6 nm | 400 nm | bi-functional aminosilane 10% | Urethane resin | A | B | B |
| Example 26 | 6 nm | 400 nm | bi-functional aminosilane 10% | Urethane resin | A | A | B |
| Example 27 | 6 nm | 400 nm | bi-functional aminosilane 10% | Urethane resin | A | A | B |
| Comparative Example 1 | 6 nm | 500 nm | Treatment with inorganic silica | Nylon resin | B | B | C |
| Comparative Example 2 | 35 nm | 500 nm | bi-functional aminosilane 10% | Urethane resin | B | A | C |
| Comparative Example 3 | 6 nm | 150 nm | bi-functional aminosilane 10% | Urethane resin | A | A | C |
| Comparative Example 4 | 6 nm | 600 nm | bi-functional aminosilane 10% | Urethane resin | C | B | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-082171, filed Apr. 18, 2017, which is hereby incorporated by reference herein in its entirety.

What is claimed is:

1. An electrophotographic photosensitive member, comprising:

an electro-conductive support;

an undercoat layer on the electro-conductive support, the undercoat layer comprising a urethane binder resin and titanium oxide secondary particles, said titanium oxide secondary particles being an aggregate of titanium oxide primary particles; and a photosensitive layer on the undercoat layer, wherein the number average particle diameter of the titanium oxide primary particles is 1 to 10 nm, and the number average particle diameter of the titanium oxide secondary particles is 200 to 500 nm.

2. The electrophotographic photosensitive member according to claim 1, wherein the titanium oxide primary particles are surface-treated with a silane coupling agent having an amino group.

3. The electrophotographic photosensitive member according to claim 1, wherein the undercoat layer contains at least one compound selected from the group consisting of Formulae (1) and (2) below (1)

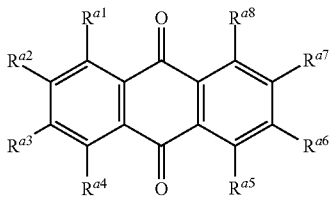

(2)

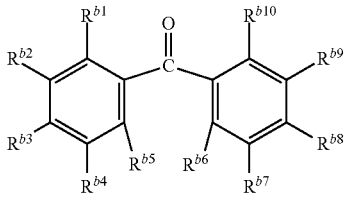

where $R^{a1}$ to $R^{a8}$ independently represent a hydrogen atom, a hydroxy group, a halogen atom, an alkyl group, an alkoxy group, a phenyl group, or an amino group), and $R^{b1}$ to $R^{b10}$ independently represent a hydrogen atom, a hydroxy group, a halogen atom, an alkyl group, an alkoxy group, a phenyl group, or an amino group.

4. The electrophotographic photosensitive member according to claim 3, wherein the compound represented by Formulae (1) or (2) is an anthraquinone compound having two or more hydroxy groups or a benzophenone compound having three or more hydroxy groups.

5. The electrophotographic photosensitive member according to claim 1, wherein a mass ratio (PB) is from 0.5/1.0 to 4.0/1.0, when (P) is the mass of titanium oxide primary particles in the undercoat layer and (B) is the mass of urethane resin in the undercoat layer.

6. The electrophotographic photosensitive member according to claim 1, wherein a mass ratio (P/B) is from 0.5/1.0 to 3.0/1.0 when (P) is the mass of titanium oxide primary particles in the undercoat layer and (B) is the mass of urethane resin in the undercoat layer.

7. The electrophotographic photosensitive member according to claim 1, wherein a mass ratio (P/B) is from 1.0/1.0 to 3.0/1.0 when (P) is the mass of titanium oxide primary particles in the undercoat layer and (B) is the mass of urethane resin in the undercoat layer.

8. The electrophotographic photosensitive member according to claim 1, wherein the thickness of the undercoat layer is 0.5 to 30 μm.

9. The electrophotographic photosensitive member according to claim 1, wherein the thickness of the undercoat layer is 2 to 30 μm.

10. The electrophotographic photosensitive member according to claim 1, wherein the thickness of the undercoat layer is 2 to 10 μm.

11. A process cartridge and at least one unit selected from the group consisting of a charging unit, a developing unit, a transferring unit and a cleaning unit, said process cartridge being detachably attachable from a main body of an electrophotographic apparatus and integrally supporting an electrophotographic photosensitive member, the electrophotographic photosensitive member comprises:

an electro-conductive support;

an undercoat layer on the electro-conductive support, the undercoat layer comprising a urethane binder resin and titanium oxide secondary particles, said titanium oxide secondary particles being an aggregate of titanium oxide primary particles; and a photosensitive layer on the undercoat layer, wherein the number average particle diameter of the titanium oxide primary particles is 1 to 10 nm, and the number average particle diameter of the titanium oxide secondary particles is 200 to 500 nm.

12. An electrophotographic apparatus comprising:

a charging unit;

an exposing unit;

a developing unit;

a transferring unit; and an electrophotographic photosensitive member, the electrophotographic photosensitive member comprising an electro-conductive support, an undercoat layer on the electro-conductive support, and a photosensitive layer on the undercoat layer, wherein the undercoat layer comprises a urethane binder resin, and titanium oxide secondary particles, said titanium oxide secondary particles being an aggregate of titanium oxide primary particles, the number average particle diameter of the titanium oxide primary particles is 1 to 10 nm, and the number average particle diameter of the titanium oxide secondary particles is 200 to 500 nm.

13. The electrophotographic apparatus according to claim 12, wherein the charging unit is configured to charge the electrophotographic photosensitive member by applying only a direct current voltage to a charging roller disposed so as to abut the electrophotographic photosensitive member.

* * * * *